US006431318B1

(12) United States Patent
Tanaka

(10) Patent No.: US 6,431,318 B1
(45) Date of Patent: Aug. 13, 2002

(54) FOOD AND DRINK CONVEYING SYSTEM

(75) Inventor: Kunihiko Tanaka, Sakai (JP)

(73) Assignee: Kura Corporation Ltd., Osaka (JP)

( * ) Notice: Subject to any disclaimer, the term of this patent is extended or adjusted under 35 U.S.C. 154(b) by 0 days.

(21) Appl. No.: 09/607,551

(22) Filed: Jun. 29, 2000

(51) Int. Cl.[7] ..... E04H 3/04

(52) U.S. Cl. ..... 186/49; 186/38; 186/49; 186/50

(58) Field of Search ..... 186/38, 49, 50

(56) References Cited

U.S. PATENT DOCUMENTS 3,641,263 A * 2/1972 Rhoads et al. ..... 178/6
4,553,222 A * 11/1985 Kurland et al. ..... 364/900
4,560,032 A * 12/1985 Imanaka ..... 186/38
4,588,047 A * 5/1986 de Reynal de Saint Michel ..... 186/38
4,840,253 A * 6/1989 DiMaggio et al. ..... 186/49
5,279,392 A * 1/1994 Casale et al. ..... 186/41
5,595,263 A * 1/1997 Pignataro ..... 186/53
5,890,136 A * 3/1999 Kipp ..... 705/22
5,979,604 A * 11/1999 Pinna et al. ..... 186/39
6,055,514 A * 4/2000 Wren ..... 705/27
6,102,162 A * 8/2000 Teicher ..... 186/39
6,145,628 A * 11/2000 Tanaka ..... 186/50
6,179,088 B1 * 1/2001 Lai ..... 186/49

* cited by examiner

*Primary Examiner*—Christopher P. Ellis
*Assistant Examiner*—Jeffrey B. Shapiro
(74) *Attorney, Agent, or Firm*—Frishauf, Holtz, Goodman & Chick, P.C.

(57) ABSTRACT

A food and drink conveying system is provided in which the sorts of foods and drinks displayed on display members placed on a circulating conveying path and the number of foods and drinks placed on the circulating conveying path following after their respective display members are detected. An optimum number of foods and drinks to be placed following after their respective display members placed on the circulating conveying path is set, and then it is judged whether or not the number of foods and drinks placed on the circulating conveying path are the optimum number based on the detected sorts and number of foods and drinks. The sorts of and the number of insufficient foods and drinks are displayed when it is judged that the number of foods and drinks placed on the circulating conveying path is smaller than the optimum, so that a food preparer can be informed of the sorts and number of insufficient foods and drinks.

1 Claim, 5 Drawing Sheets

Fig. 5

| SORTS | CROWDED | NOT CROWDED |
|---|---|---|
| FATTY BELLEY OF TUNA | 5 DISHES | 4 DISHES |
| YELLOWTAIL | 5 DISHES | 4 DISHES |
| SQUID | 5 DISHES | 4 DISHES |
| EEL | 4 DISHES | 3 DISHES |
| HORSE MACKEREL | 4 DISHES | 3 DISHES |
| SALMON | 3 DISHES | 2 DISHES |
| EGGS | 3 DISHES | 2 DISHES |
| OCTOPUS | 3 DISHES | 2 DISHES |

FOOD AND DRINK CONVEYING SYSTEM

BACKGROUND OF THE INVENTION

1. Field of the Invention

The present invention relates to a food and drink conveying system, set in an eating place, a sushi shop in particular, for circulating e.g. dished-up sushi by means of a circulating conveying path so that customers can take the circulating dished-up sushi at their own choice.

2. Description of the Prior Art

In recent years, there have been an increasing number of sushi shops that have introduced a food and drink conveying system having a circulating conveying path that circulates along a number of tables or counters set in the sushi shop. In the sushi shop using the food and drink conveying system, a food preparer makes sushi in the kitchen by making a small, oval-shaped, vinegared rice ball and then putting a topping, such as raw fish, on the vinegard rice ball; dishes up the sushi on a plate; and puts the plate on the circulating conveying path, to sequentially convey the dished-up sushi on the plate to respective tables in the dining area so that customers can take from the circulating sushi the variety of their own choice.

The food and drink conveying system is designed to supply dished-up foods and drinks to the circulating conveying path, as mentioned above. The foods and drinks on the circulating conveying path are circulated all the time and, accordingly, it is very hard for the food preparer to keep track of the number of foods or drinks per sort of article. Due to this, the conventional conveying system has the disadvantage that some sorts of articles which are in big demand are sometimes all gone from the circulating conveying path without the food preparer's knowledge, resulting in inconvenience to the customers.

In consideration of this circumstance, the present invention has been developed. It is the object of the invention to provide a food and drink conveying system capable of keeping track of the number of foods and drinks placed on the circulating conveying path per sort of article, and that is also capable of informing the food preparer of the sorts and the number of insufficient articles.

SUMMARY OF THE INVENTION

To achieve the object above, the present invention is directed to a novel food and drink conveying system wherein display members for displaying sorts of foods and drinks are placed on a circulating conveying path, and the foods and drinks displayed by the display members are placed in order following after their respective display members. The food and drink conveying system of the present invention comprises food and drink detecting means for detecting the sorts of foods and drinks displayed on the display members placed on the circulating conveying path and the number of foods and drinks placed on the circulating conveying path following after their respective display members; an optimum number setting means for setting an optimum number of foods and drinks to be placed following after their respective display members placed on the circulating conveying path; number judgment means for judging whether or not the number of foods and drinks placed on the circulating conveying path are the optimum number set by the optimum number setting means based on signals output from the food and drink detecting means; and display means for displaying the sorts of and the number of insufficient foods and drinks when the number judgment means judges that the number of foods and drinks placed on the circulating conveying path is smaller than the optimum number set by the optimum number setting means, so that a food preparer can be informed of the sorts and number of insufficient foods and drinks. This construction can produce the result that the food preparer can immediately know about the sorts and number of insufficient foods and drinks by simply watching the display means. This can provide the advantage that the food preparer can only be required to make sushi or other foods in order in accordance with the information displayed on the display means, without worrying about the number and sorts of sushi or other foods flowing over the circulating conveying path, as in the prior art.

BRIEF DESCRIPTION OF THE DRAWINGS

In the drawings:

FIG. 5 is an illustration showing one example of an optimum number of sushi per sort of sushi.

DETAILED DESCRIPTION OF THE EMBODIMENTS

Referring now to the accompanying drawings, an example of a preferred embodiment of the present invention directed to a food and drink conveying system will be described below. It is to be understood, however, that the scope of the invention is by no means limited to the illustrated embodiment.

Figure 1:
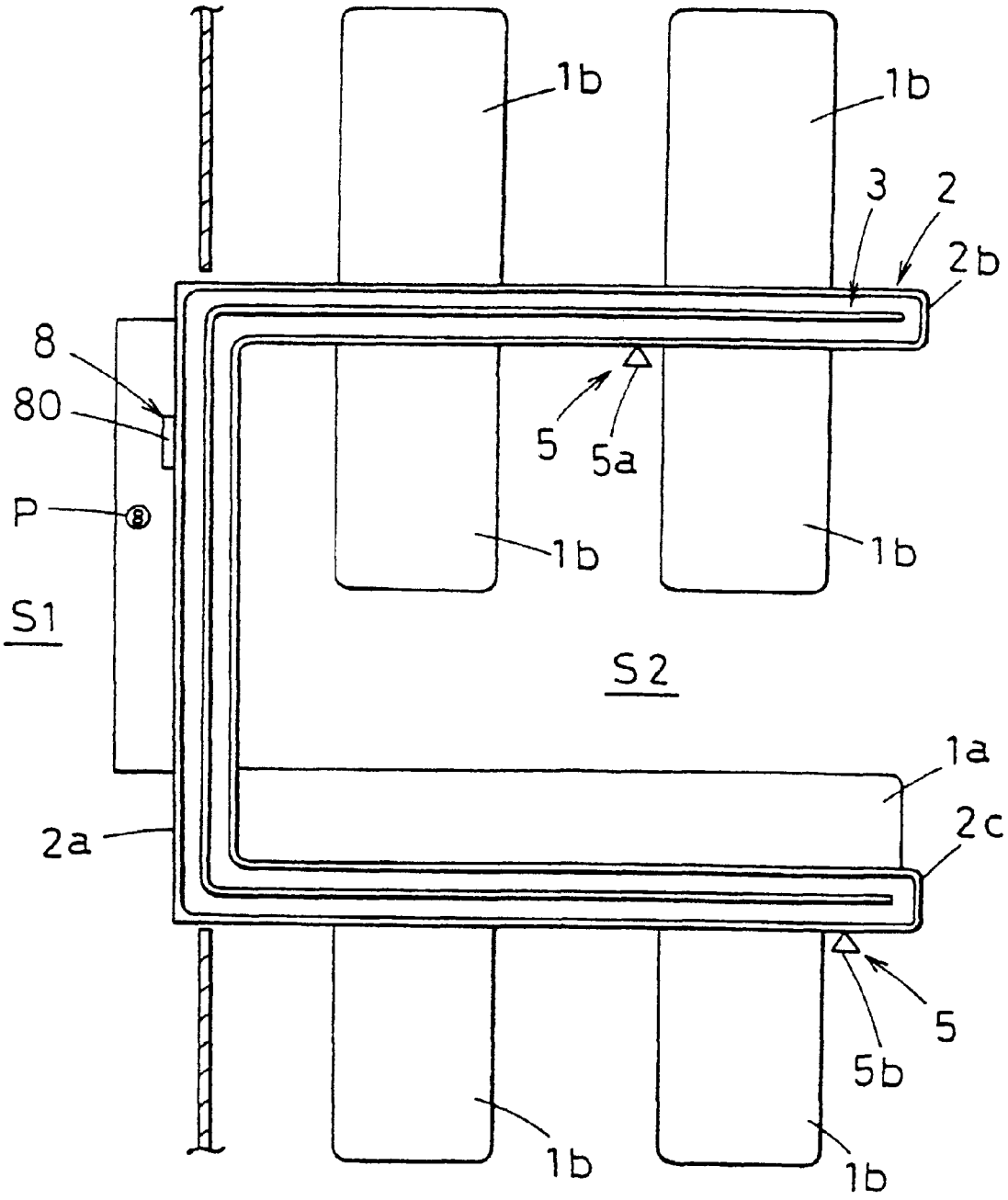
FIG. 1 is a schematic plan view of an interior of an eating house in which a food and drink conveying system of the invention is set.

Referring to FIG. 1, there is shown an interior of a sushi shop having a kitchen S1 and a dinning area S2 as viewed from above in which there are provided a counter 1*a* and a plurality of tables 1*b* set in the dinning area S2; a compartment housing 2 arranged along a front side of the kitchen S1 and along the counter and tables 1*a*, 1*b*; and a food and drink conveying system according to the present invention having a circulating conveying path 3, circularly arranged on the compartment housing 2, for circularly conveying sushi dished up on plates P in the kitchen S1.

Figure 2:
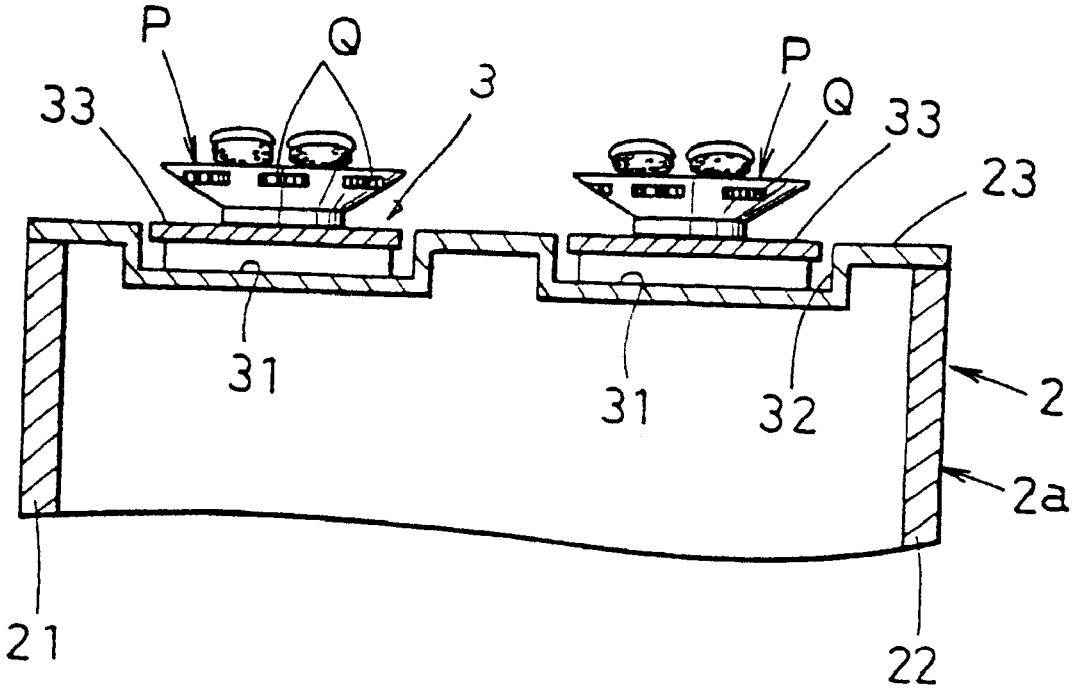
FIG. 2 is an enlarged sectional view of a principal part of the same.

As shown in FIG. 2, the compartment housing 2 is formed to have a box shape in section which is formed by spaced apart, opposite, side walls 21, 22, a top wall 23 and a bottom wall (not shown) connecting between the both side walls 21, 22 at upper and lower ends thereof. The compartment housing 2 comprises a first housing portion 2*a*, arranged along the front side of the kitchen S1, for separating the kitchen S1 from the dinning area S2; second and third housing portions 2*b*, 2*c* bending from both lengthwise ends of the first housing portion 2*a* and extending in parallel in the dinning area S2. The counter 1*a* and the tables 1*b* are arranged alongside of the side walls 21, 22 at the second and third housing portions 2*b*, 2*c*. Hereinafter, the counter 1*a* and the tables 1*b* sometimes are simply referred to as the tables.

The circulating conveying path 3 of the food and drink conveying system comprises a recess 31 provided in the top wall 23 of the housing portions 2*a*, 2*b* and 2*c*; and a flat endless chain 33 which is moved in circulation in the recess 31 by motor drive while it is guided along guide walls 32 provided at both widthwise sides of the recess 31.

Figure 4:
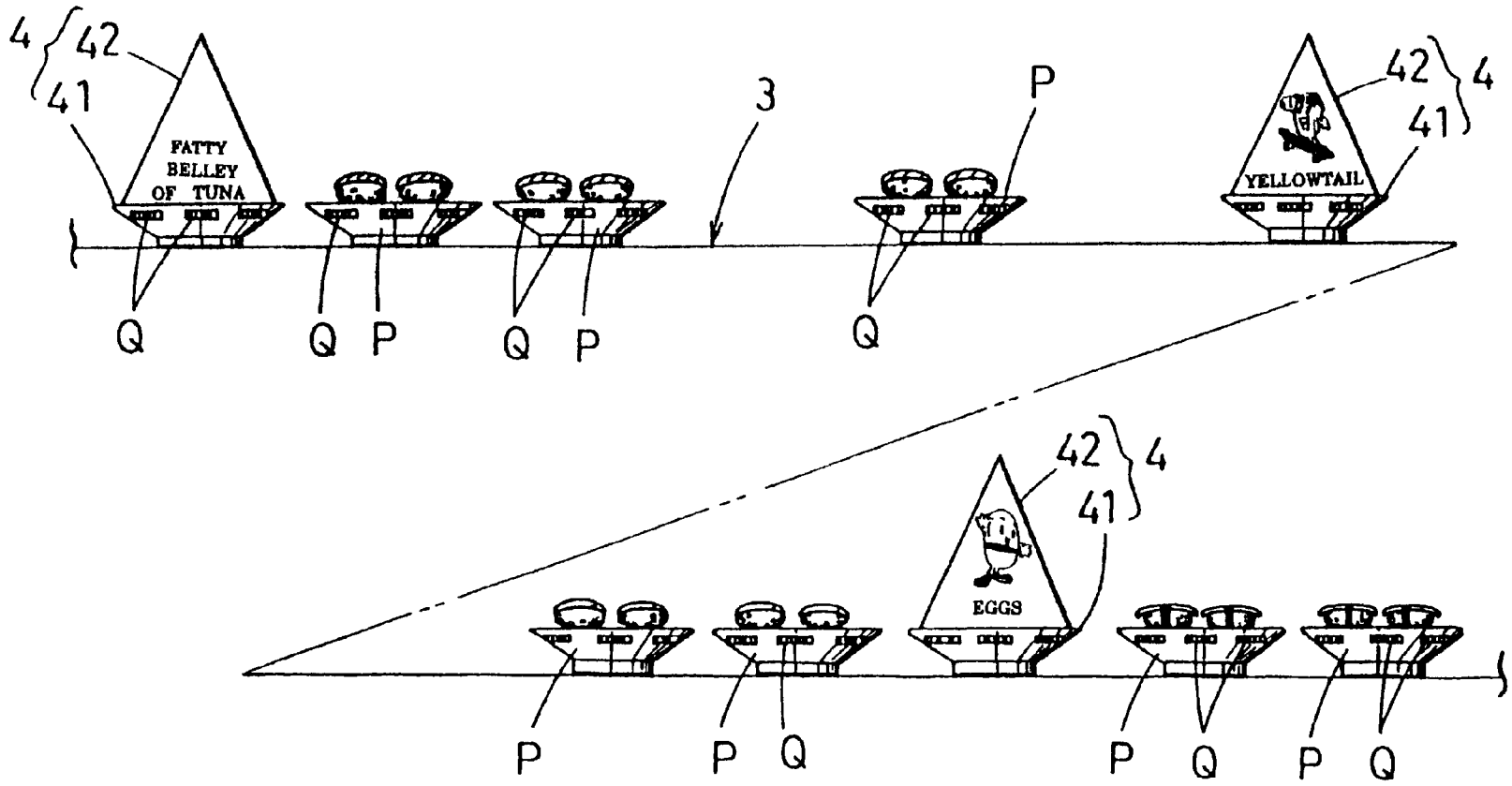
FIG. 4 is an illustration showing the used state of display members and sushi-plates supplied to the circulating conveying path.

In the illustrated embodiment, as shown in FIG. 4, the food and drink conveying system thus constructed includes display members 4 for the respective sorts of the sushi to be placed on the circulating conveying path 3. Each display member 4 is composed of a plate 41 for which the aforesaid plate P is used and a cone-shaped display 42 which is to be put up on the plate 41 and is loaded with characters/letters and illustrations representing the sorts of sushi, such as toro (fatty belley of tuna), ika (squid), hamachi (yellowtail), etc.

Seals Q, each having printed thereon a QR code as an identifying mark for identifying the respective plate P and the respective display member 4, are affixed around the outside of the plate P on which the sushi is dished up and around the outside of the plate 41 of the display member 4.

In addition to the QR code, for example a bar code may be printed on the each seal as the identifying mark.

Figure 3:
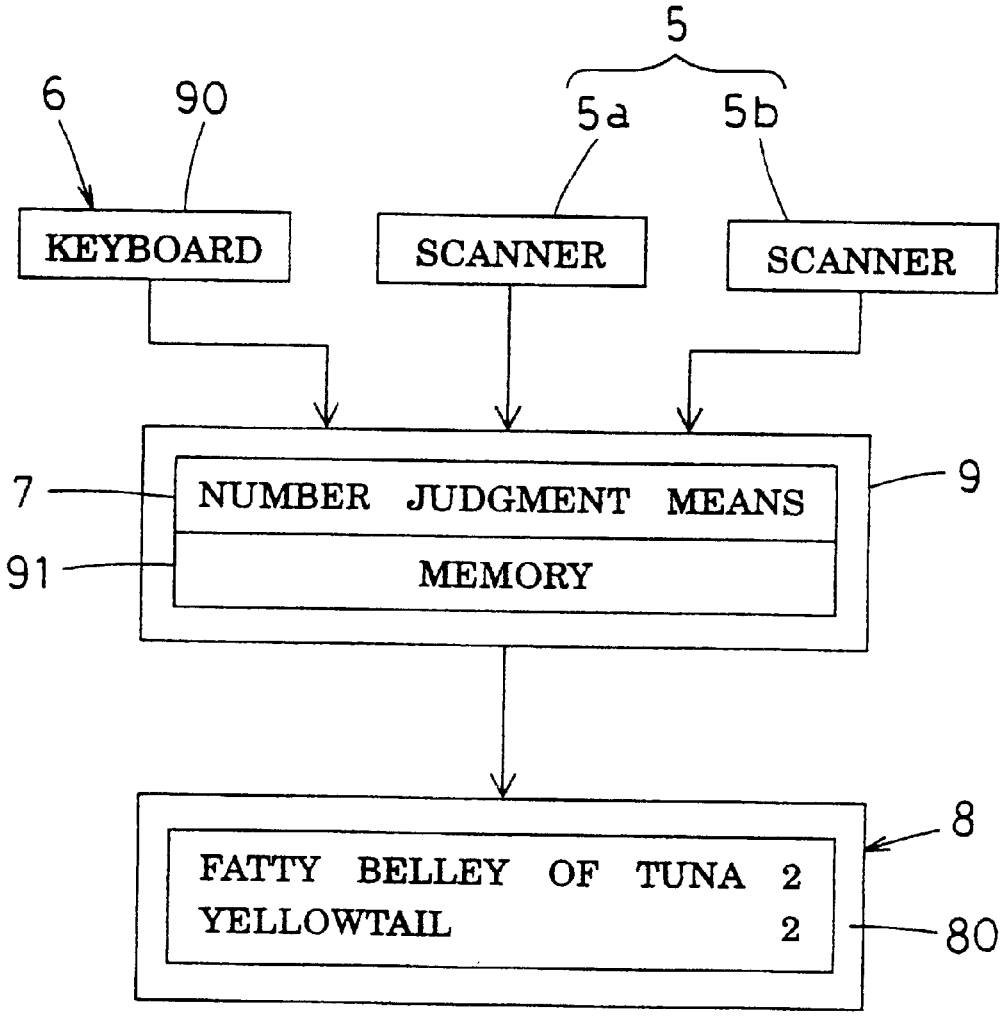
FIG. 3 is a block diagram of a food and drink conveying system of the present invention.

As shown in FIG. 3, the food and drink conveying system thus constructed is provided with food and drink detecting means 5 for detecting the sorts of foods and drinks displayed on the display members 4 placed on the circulating conveying path 3 and the number of foods and drinks placed on the circulating conveying path 3 following after their respective display members 4; an optimum number setting means 6 for setting an optimum number of foods and drinks to be placed on the circulating conveying path 3 following after their respective display members 4 placed on the circulating conveying path 3; number judgment means 7 for judging whether or not an actual number of foods and drinks on the circulating conveying path 3 are the optimum number set by the optimum number setting means 6 based on signals output from the food and drink detecting means 5; and display means 8 for displaying the sorts of and the number of insufficient foods and drinks when the number judgment means 7 judges that the actual number of foods and drinks placed on the circulating conveying path 3 is smaller than the optimum number set by the optimum number setting means 6.

In the illustrated embodiment, the food and drink detecting means 5 is composed of laser scanners 5*a*, 5*b*. The identifying marks of the seals Q which are affixed to the plate 41 of the display member 4 and to the plate P on which the food or the drink is dished up, respectively, are read by the scanners 5*a*, 5*b*. In the illustrated embodiment, the scanners 5*a*, 5*b* are provided at two locations, i.e., the second housing portion 2*b* and the third housing portion 2*c*.

The number judgment means 7 may be achieved by a program of a control unit 9 composed of a computer for controlling the drive of the food and drink conveying system. A keyboard 90 connected to an input side of the control unit 9 is used as the optimum number setting means 6. The optimum number of the foods and drinks to be placed following after their respective display members 4 on the circulating conveying path 3 are entered from the keyboard 90 to the control unit 9.

Specifically, for example, the optimum number of sushi required when the shop is crowded with customers and the optimum number of sushi required when the shop is not crowded with customers are kept stored in a memory 91 of the control unit 9, as shown in FIG. 5. The optimum number of sushi plates to be placed on the circulating conveying path 3 following after their respective display members 4 are selected from the memory 91 of the control unit 9 by the key-in operation of the keyboard 90 in conformity to the number of customers.

The optimum number of sushi per sort of sushi may be individually set by the key-in operation of the keyboard 90.

The display means 8 shown in the drawings is composed of a monitor 80 using CRT or liquid crystal. The monitor 80 is placed in the kitchen S1 and is connected to the output side of the control unit 4.

In use of the food and drink conveying system thus constructed, the identifying marks affixed to the plate 41 of each display member 4 are read in advance by the scanners 5*a*, 5*b*, so that the information is kept stored in the memory 91 of the control unit 9, together with the sorts of sushi displayed on the displays 42 of their respective display members 4.

Then, the optimum number of the sushi plates P to be placed on the circulating conveying path 3 following after their respective display members 4 are entered from the keyboard 90 to the control unit 9, before the sushi are conveyed to the respective tables in the dinning area S2 by the food and drink conveying system. For example, when the shop is crowded with customers, the optimum number of sushi required when the shop is crowded with customers (FIG. 5) is selected among the optimum number set by the program of the control unit 9. On the other hand, when the shop is not crowded with customers, the optimum number of sushi required when the shop is not crowded with customers (or is in normal state) (FIG. 5) is selected among the optimum number set in the memory 91 of the control unit 9. Thereafter, only the set number of sushi plates P dishing up thereon the sushi of the sorts displayed by the related display members 4 are placed following after their respective display members 4 placed on the circulating conveying path 3.

The sushi supplied to the circulating conveying path 3 are conveyed in circulation to the tables 1*a*, 1*b* in the dinning area S2. The customers at the tables 1*a*, 1*b* take out the plates P dishing thereon their favorite sushi from the circulating conveying path 3 at their own choice to eat it. The plates P not taken out by the customers are circulated through the circulating conveying path 3.

The identifying marks of the respective plates flowing over the circulating conveying path 3 are sequentially read by the scanners 5*a*, 5*b* and this information is output to the control unit 9 therefrom. Then, the control unit 9 compares the read information with the data on the identifying marks of the display members 4 stored in the memory 91, to recognize the respective display members 4 and count the number of plates P placed following after their respective display members 4. If the counted number of plates is smaller than the set number of plates, then the sorts and the number of insufficient sushi are displayed on the screen of the monitor 80, as shown in FIG. 3.

When the sorts and number of insufficient sushi are displayed by the monitor 80, the food preparer in the kitchen S1 makes those sushi (for example, two dishes of toro (fatty belley of tuna) and hamachi (yellowtail) in FIG. 3) and dishes them up on the plates P. Then, when the display member 4 of toro (fatty belley of tuna) comes into the kitchen, the required dishes of toro (fatty belley of tuna) are placed in a space behind the related display member 4. When the display member 4 of hamachi (yellowtail) comes into the kitchen, the required dishes of hamachi (yellowtail) are placed in a space behind the related display member 4. Thereafter, the information displayed on the monitor is cleared by the operation of the keyboard 90.

What is claimed is:

1. A food and drink conveying system comprising:

a circulating conveying path for conveying a plurality of items of food and drink;

a plurality of tables arranged along the circulating conveying path;

a plurality of display members provided on the circulating conveying path at respective positions corresponding to respective types of the food and drink items for displaying the types of the food and drink items placed on the circulating conveying path;

food and drink detecting means for detecting the types of the food and drink items displayed by the display members and a number of the food and drink items of each type present on the circulating conveying path;

optimum number setting means for setting an optimum number of the food and drink items of each type to be placed on the circulating conveying path;

number judgment means for judging whether or not the number of food and drink items of each type present on the circulating conveying path matches the optimum number set by the optimum number setting means based on signals output from the food and drink detecting means; and display means for displaying the types and the number of insufficient food and drink items when the number judgment means judges that the number of the food and drink items present on the circulating conveying path is smaller than the optimum number set by the optimum number setting means.

* * * * *